US008539723B2

(12) United States Patent
Ramsey et al.

(10) Patent No.: US 8,539,723 B2
(45) Date of Patent: Sep. 24, 2013

(54) BACK PRESSURED HYDRAULIC PUMP FOR SUCKER ROD

(71) Applicants: Michael C. Ramsey, The Woodlands, TX (US); Michael L. Finley, Nacogdoches, TX (US)

(72) Inventors: Michael C. Ramsey, The Woodlands, TX (US); Michael L. Finley, Nacogdoches, TX (US)

(73) Assignee: Downhole Water Management, Inc., Nacogdoches, TX (US)

( * ) Notice: Subject to any disclaimer, the term of this patent is extended or adjusted under 35 U.S.C. 154(b) by 0 days.

(21) Appl. No.: 13/656,842

(22) Filed: Oct. 22, 2012

(65) Prior Publication Data

US 2013/0043037 A1 Feb. 21, 2013

Related U.S. Application Data

(60) Division of application No. 12/803,478, filed on Jun. 28, 2010, now Pat. No. 8,336,613, which is a continuation-in-part of application No. 11/985,667, filed on Nov. 16, 2007, now abandoned.

(51) Int. Cl.
*E04H 12/34* (2006.01)

(52) U.S. Cl.
USPC ..... 52/116; 52/651.05

(58) Field of Classification Search
USPC ..... 52/112, 116, 651.05, 652.1, 651.02, 52/651.11, 651.04, 651.07, 849, 848, 836, 52/654.1, 690, 223.4
See application file for complete search history.

(56) References Cited

U.S. PATENT DOCUMENTS

| | | | | | |
|---|---|---|---|---|---|
| 820,992 | A * | 5/1906 | Schwarz | 52/116 |
| 925,440 | A * | 6/1909 | Stone | 52/116 |
| 2,052,301 | A * | 8/1936 | Johansen | 173/188 |
| 2,204,716 | A * | 6/1940 | Woody | 52/116 |
| 2,403,080 | A * | 7/1946 | Hilborn | 52/120 |
| 2,889,898 | A * | 6/1959 | Woolslayer et al. | 52/117 |
| 2,946,561 | A * | 7/1960 | Thorson et al. | 254/337 |
| 3,483,933 | A * | 12/1969 | Dyer et al. | 173/39 |
| 3,715,852 | A * | 2/1973 | Koga et al. | 52/745.18 |
| 3,995,701 | A * | 12/1976 | Kelly, Jr. | 173/191 |
| 6,065,267 | A * | 5/2000 | Fisher | 52/692 |
| 8,112,946 | B2 * | 2/2012 | Vogt | 52/116 |
| 2003/0172599 | A1 * | 9/2003 | Frink | 52/116 |
| 2011/0072737 | A1 * | 3/2011 | Wasterval | 52/115 |

* cited by examiner

*Primary Examiner* — Joshua J Michener
*Assistant Examiner* — BaBaJide Demuren
(74) *Attorney, Agent, or Firm* — John R Casperson

(57) ABSTRACT

A hydraulic pump includes a hydraulic cylinder assembly comprising a cylinder sealed by an upper head and a lower head and carrying a piston which divides the hydraulic cylinder assembly into an upper chamber and a lower chamber. A load is connected to the piston and urges it toward the lower head. A conduit connects a reversible hydraulic pump assembly in fluid flow communication with a pressurized supply of hydraulic fluid and the lower chamber for counterbalancing the load. A control system is operably associated with the reversible hydraulic pump assembly to cause hydraulic fluid to flow back and forth between the lower chamber of the hydraulic cylinder assembly and the pressurized supply of hydraulic fluid. A system is also provided to counteract leakage in the pump by adding hydraulic fluid makeup on an as needed and controlled basis.

2 Claims, 10 Drawing Sheets

BACK PRESSURED HYDRAULIC PUMP FOR SUCKER ROD

CROSS REFERENCES TO RELATED APPLICATIONS

This application is a division of application Ser. No. 12/803,478 filed Jun. 28, 2010, now U.S. Pat. No. 8,336,613, which was a continuation-in-part of application Ser. No. 11/985,776, filed Nov. 17, 2007, now abandoned, which claimed the benefit of U.S. Provisional Application No. 60/859,676 filed Nov. 17, 2006. The disclosures of these earlier filed applications are incorporated by reference herein.

FIELD OF THE INVENTION

In certain embodiments, the invention relates to a method and apparatus for operating a hydraulic cylinder to actuate a downhole pump coupled to the cylinder via a sucker rod linkage. In one aspect, the invention relates to a derrick useful for oil and gas operations.

BACKGROUND OF THE INVENTION

Mechanical pump jacks have been used for many years in the oil and gas industry to remove liquids from deep wells. Typically, a rocking beam is connected at one end to a string of sucker rods which actuates a downhole pump mechanism and is counterbalanced with heavy weights at the other end to reduce the uplift force required to raise the sucker rod and liquids contained in the well.

One of the drawbacks of this arrangement is that the sucker rod string follows a generally nonadjustable sinusoidal velocity profile. Certain well applications may be limited by a maximum permissible upstroke and/or downstroke velocity. When coupled with the fixed sinusoidal motion of the rocking beam, the velocity limitation constrains the overall stroke rate, and therefore the overall well production rate.

Furthermore, the loads generated by the dynamics of the system may dictate that the well is best operated according to some profile other than the generally nonadjustable sinusoidal profile. The overall efficiency of the system and component life may be improved by reciprocating the well according to an alternate velocity profile. A system which permits adjustment of the stroke velocity profile would be very desirable.

Hydraulic systems, which permit a greater degree of control of the velocity of the sucker rod string, are known. In general, these systems utilize a secondary cylinder or pressure area to assist the primary cylinder and provide counterbalance. Since the upstroke and downstroke forces are in the same direction, some of the energy put into the system on the upstroke may be recovered, through the use of counterbalance, on the downstroke. However, the addition of another cylinder to the system reduces reliability, often increases overall height, and increases system complexity. A hydraulic unit that provides a means for counterbalance without the addition of a second cylinder would create a simpler, more space efficient, and inherently more reliable machine.

An additional shortcoming of both existing prior art hydraulic and mechanical systems is that no means are provided for diagnosing the development of problems downhole. For example, failure of the pump, leakage in the pump, changes in the liquid makeup in the well, dry bottom conditions in the well, excessive sucker rod drag, will all manifest themselves by changes over time in the work increments being done by the unit. A system to track these increments to permit diagnosis of problems downhole would be very desirable. Also, a system to counteract leakage in the pump by adding hydraulic fluid makeup on an as needed and controlled basis would be very desirable, as some leakage in the pump is inherent.

Pump jacks do not require a derrick for operability. A derrick is required for a hydraulic actuator for sucker rod. A derrick which is easy to transport and assemble and is inexpensive would be very desirable for use with hydraulic sucker rod actuator systems.

OBJECTS OF THE INVENTION

It is an object of this invention to provide a hydraulic system for actuating a well sucker rod that provides equivalent or superior efficiencies as compared to a counterbalanced mechanical system.

It is a further object of this invention to provide a hydraulic system for actuating well sucker rod that permits infinite control over the sucker rod velocity profile.

It is a further object of this invention to provide a hydraulic system for actuating well sucker rod that provides for the recordation of measurements so that downhole hole problems can be quickly identified and corrected if necessary.

It is another object of this invention to provide a derrick which is highly suitable for use with a hydraulic sucker rod system.

It is another object of this invention to provide methods for controlling the velocity profile of reciprocating well sucker rod.

SUMMARY OF THE INVENTION

In one embodiment of the invention, there is provided an apparatus comprising a hydraulic cylinder assembly, a load connected to the cylinder, a reversible hydraulic pump assembly, a pressurized supply of hydraulic fluid, first and second conduits for hydraulic fluid, and a control system. The hydraulic cylinder assembly comprises a cylinder sealed by an upper head and a lower head and carrying a piston which divides the hydraulic cylinder assembly into an upper chamber and a lower chamber. The load is connected to the piston and urges it toward the lower head. The first conduit for hydraulic fluid connects the reversible hydraulic pump assembly in fluid flow communication with a lower chamber of the hydraulic cylinder assembly. The second conduit for hydraulic fluid connects the reversible hydraulic pump assembly in fluid flow communication with the pressurized supply of hydraulic fluid. The pressurized supply of hydraulic fluid is compatible with the hydraulic pump assembly. The control system is operably associated with the reversible hydraulic pump assembly to cause hydraulic fluid to flow back and forth between the lower chamber of the hydraulic cylinder assembly and the pressurized supply of hydraulic fluid.

Use of the pressurized source of hydraulic fluid permits the load to be raised and lowered with less delta P being generated by the hydraulic pump.

Another aspect of the invention provides a tripod derrick. The derrick comprises a first leg, a second leg, and a third leg, each leg having an upper end and a lower end. The derrick further comprises a first runner strip and a second runner strip each having a first portion and a second portion and a hinge connecting the first portion and the second portion. The derrick further comprises a tip-top assembly and a cross-brace beam. The tip-top assembly is connected to the upper end of each of the first leg, the second leg, and the third leg. The first runner strip and the second runner strip are positioned side by side and parallel to each other and the cross brace beam connects the first portion of the first runner strip and the first portion of the second runner strip at a position near the hinge. The lower end of the first leg is mounted to the cross brace beam near a location midway between the first runner strip and the second runner strip. The lower end of the second leg is mounted to the first portion of the first runner strip, the cross brace being connected between the second leg and the hinge, and the lower end of the third leg is mounted to the first portion of the second runner strip, the cross-brace being connected between the third leg and the hinge. The legs are laid out in a triangular pitch and are inclined inwardly and upwardly toward the tip-top assembly.

The hinges permit the derrick to be assembled at ground level and then tipped into an upright orientation, as well as permitting the unit to be quickly lowered to permit work-over crews to access the well.

Another aspect of the invention provides a method for pumping a well. In the method, a sucker rod actuated pump is provided in the well. The pump is connected via a sucker rod string and piston shaft to a piston in a hydraulic cylinder positioned at the wellhead. The piston divides the hydraulic cylinder into an upper chamber and a lower chamber. Hydraulic fluid is supplied to the lower chamber to move the piston to an upper limit of travel near the upper end of the hydraulic cylinder. The piston reaching its upper limit of travel is sensed. Then hydraulic fluid is removed from the lower chamber to permit the piston move to a lower limit of travel near the lower end of the hydraulic cylinder. The piston reaching its lower limit of travel is sensed. Then these last four steps are repeated to pump fluids from the well.

DETAILED DESCRIPTION OF THE INVENTION

Figure 1:
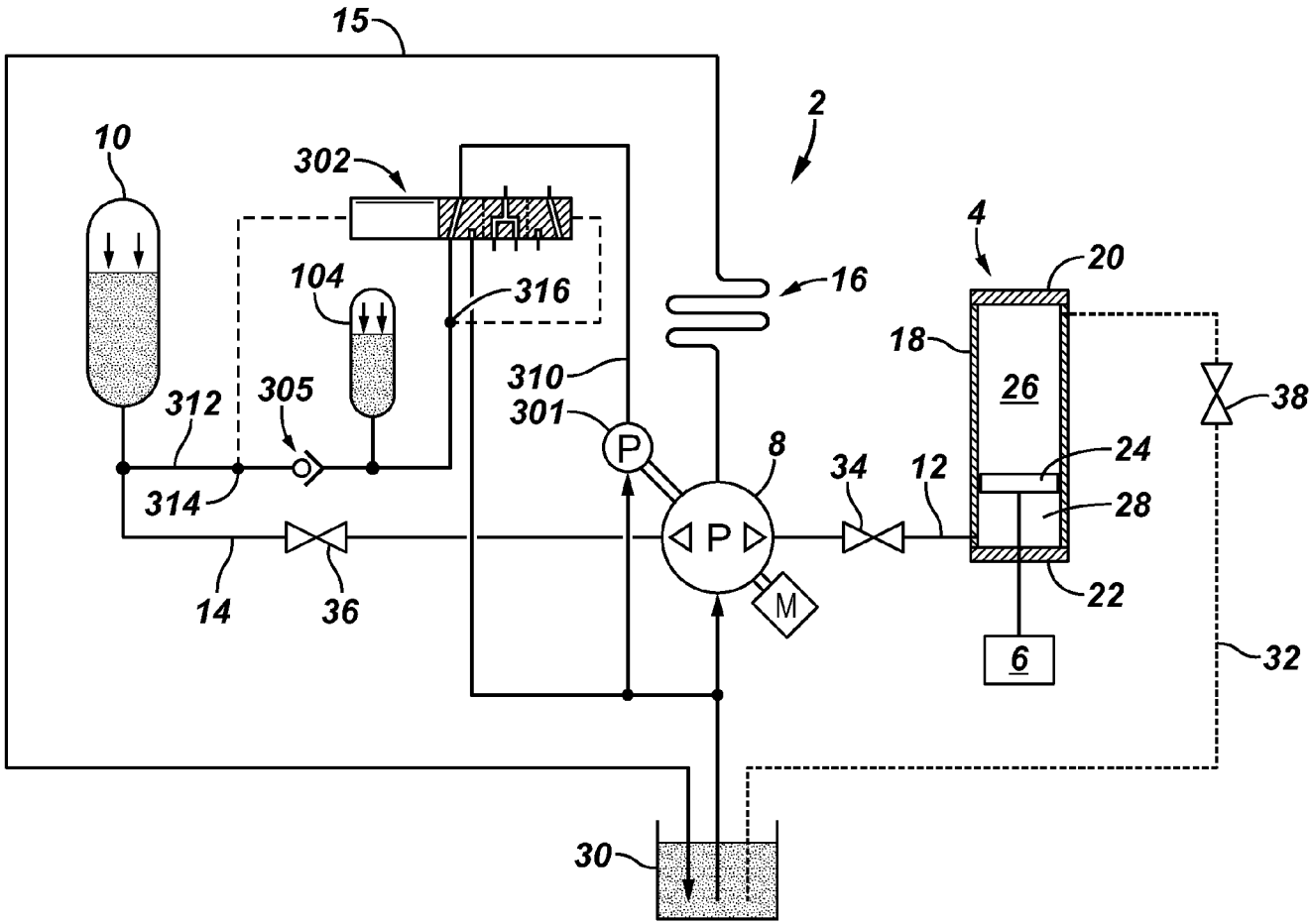
FIG. 1 is a process schematic of one embodiment of the invention.
Figure 7:
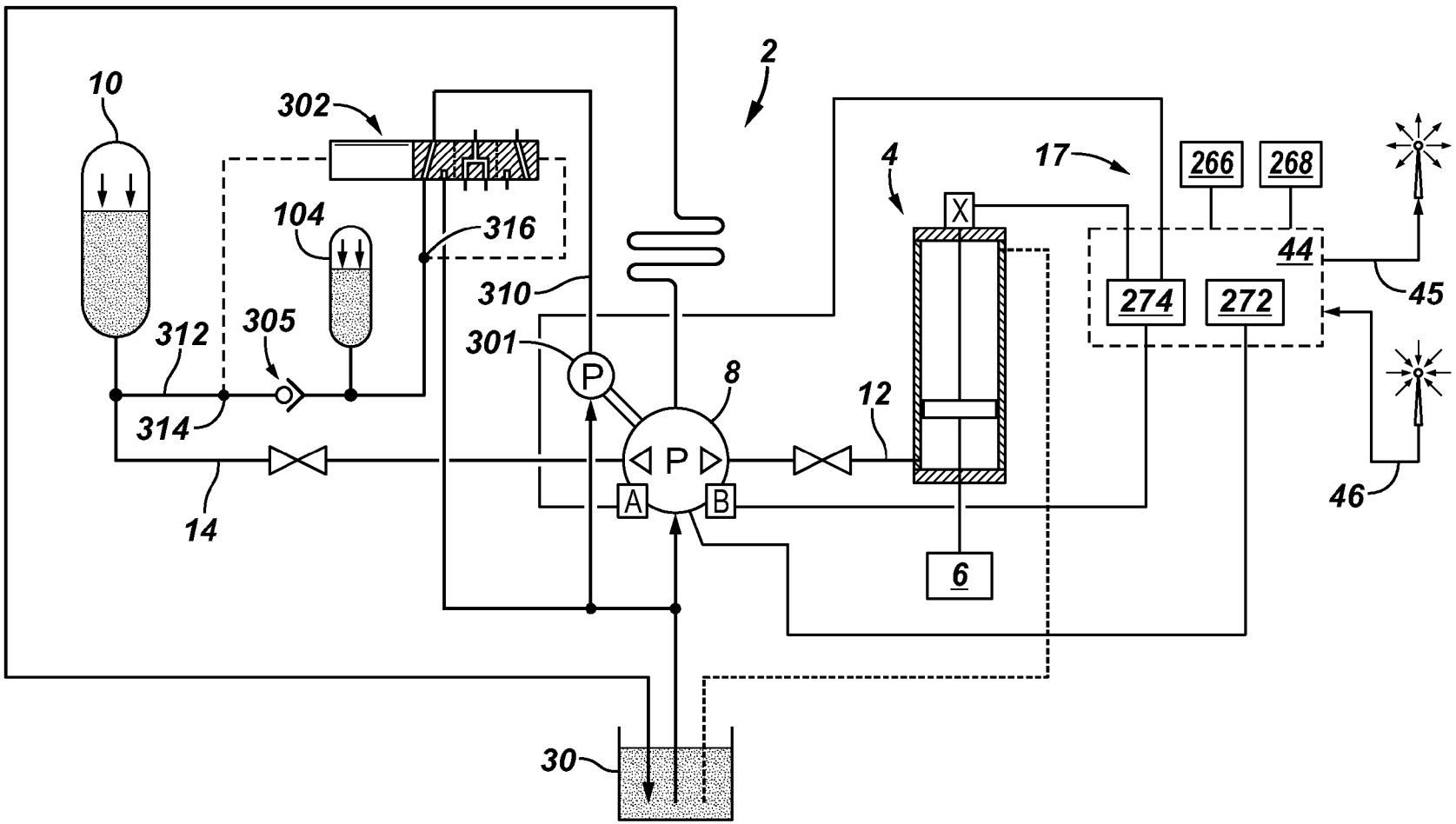
FIG. 7 is a process schematic of illustrating sensor and transmitter positions which can be employed in conjunction with the system of FIG. 6. Pressure at ports A and B determines load. Position sensor describes piston position X.

With reference to FIG. 1, there is shown schematically an apparatus 2 comprising a hydraulic cylinder assembly 4, a load 6 connected to the cylinder assembly, a reversible hydraulic pump assembly 8, a pressurized supply 10 of hydraulic fluid, a first conduit for hydraulic fluid 12, and a second conduit for hydraulic fluid 14. FIG. 7 further shows schematically a control system 17 for the unit. The hydraulic cylinder assembly, detailed in FIG. 9, comprises a cylinder 18 sealed by an upper head 20 and a lower head 22 and carrying a piston 24 which divides the hydraulic cylinder assembly into an upper chamber 26 and a lower chamber 28. The load is connected to the piston and urges it toward the lower head. See FIG. 1. The first conduit for hydraulic fluid connects the reversible hydraulic pump assembly in fluid flow communication with the lower chamber of the hydraulic cylinder assembly. The second conduit for hydraulic fluid connects the reversible hydraulic pump assembly in fluid flow communication with the pressurized supply of hydraulic fluid. The pressurized supply of hydraulic fluid is compatible with the hydraulic pump assembly. The control system is operably associated with the reversible hydraulic pump assembly to cause hydraulic fluid to flow back and forth between the lower chamber of the hydraulic cylinder assembly and the pressurized supply of hydraulic fluid.

The pressurized supply of hydraulic fluid is preferably maintained at an adequate pressure to counterbalance the downward load on the piston so that the reversible hydraulic pump assembly demands similar peak power to operate the piston during the downstroke and during the upstroke. Preferably, the pressurized source of hydraulic fluid comprises a pressure vessel containing hydraulic fluid in a lower portion thereof and a head of pressurized gas in an upper portion thereof. More preferably, the pressurized gas consists essentially of nitrogen. The apparatus preferably further comprises a reservoir 40 of pressurized nitrogen, to allow replenishment if necessary. See FIG. 8. Also shown in FIG. 8 is a cooler 16 to cool hydraulic fluid carried by a bypass conduit 15 for hydraulic fluid from the pump to the hydraulic fluid reservoir.

Figure 8:
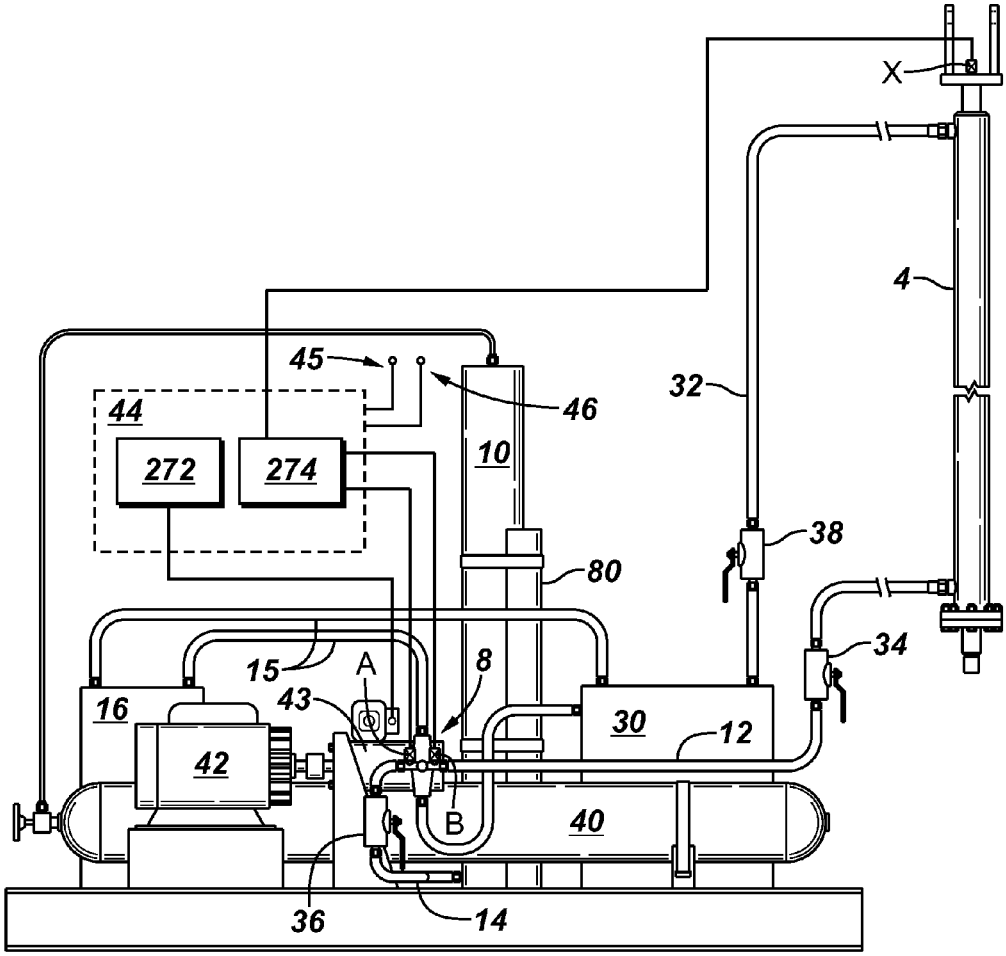
FIG. 8 is a side pictorial view of one embodiment of the invention.

In the illustrated embodiment of FIG. 8, the apparatus further includes a reservoir 30 of hydraulic fluid, and a third conduit 32 for hydraulic fluid connecting the upper chamber of the hydraulic cylinder assembly with the reservoir of hydraulic fluid. A first ball valve 34 is provided in the first conduit for hydraulic fluid, a second ball valve 36 is provided in the second conduit for hydraulic fluid, and a third ball valve 38 is provided in the third conduit for hydraulic fluid for isolating different components of the apparatus. The valves provide a means for locking the cylinder in place, an important feature for use on well sites.

The hydraulic pump assembly preferably comprises an electric motor 42 coupled to a reversible, variable displacement, pump unit 43. See FIG. 8. The pump unit provides the required pressure differential to move fluid from the lower chamber of the cylinder to the pressurized supply of hydraulic fluid to create the downstroke of the piston and the required pressure differential to move fluid from the pressurized supply of hydraulic fluid to the lower chamber of the cylinder to create the upstroke of the piston. The pump unit preferably further comprises a plurality of pistons operably associated with a moveable plate which is adjustable to control fluid flow rate and direction through the pump unit, and at least one actuator for the plate. Suitable pump units are known to the art.

The control system is preferably operable to reverse the direction of hydraulic fluid flow through the pump unit when the piston is at predetermined distances from the upper head and the lower head.

The control system preferably includes at least one position sensor X (FIGS. 7 and 8) that detects the position of the cylinder within the limits of the stroke.

Figure 9:
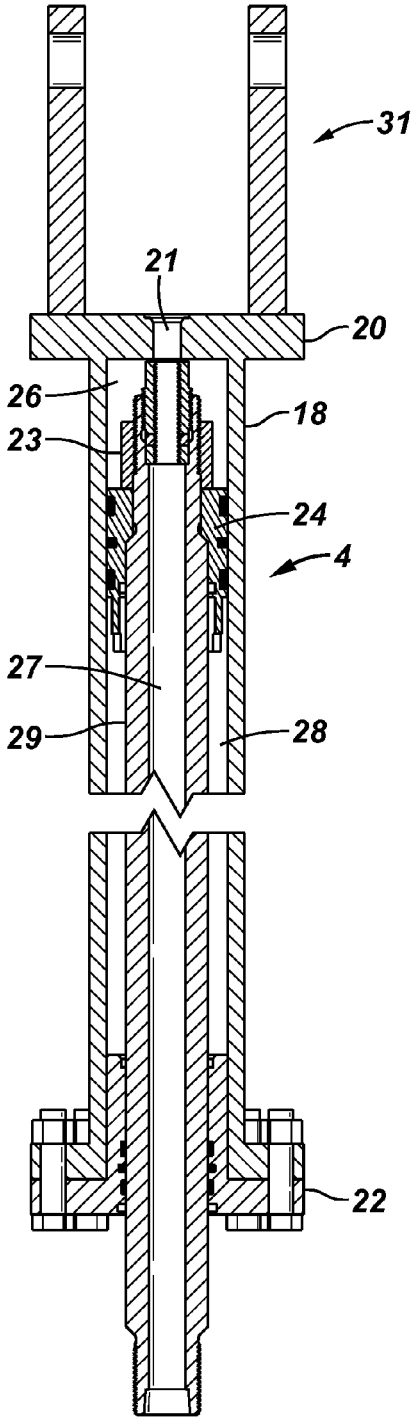
FIG. 9 is a cross-sectional view of a portion of the apparatus shown in FIG. 8, illustrating details of the cylinder.
Figure 10:
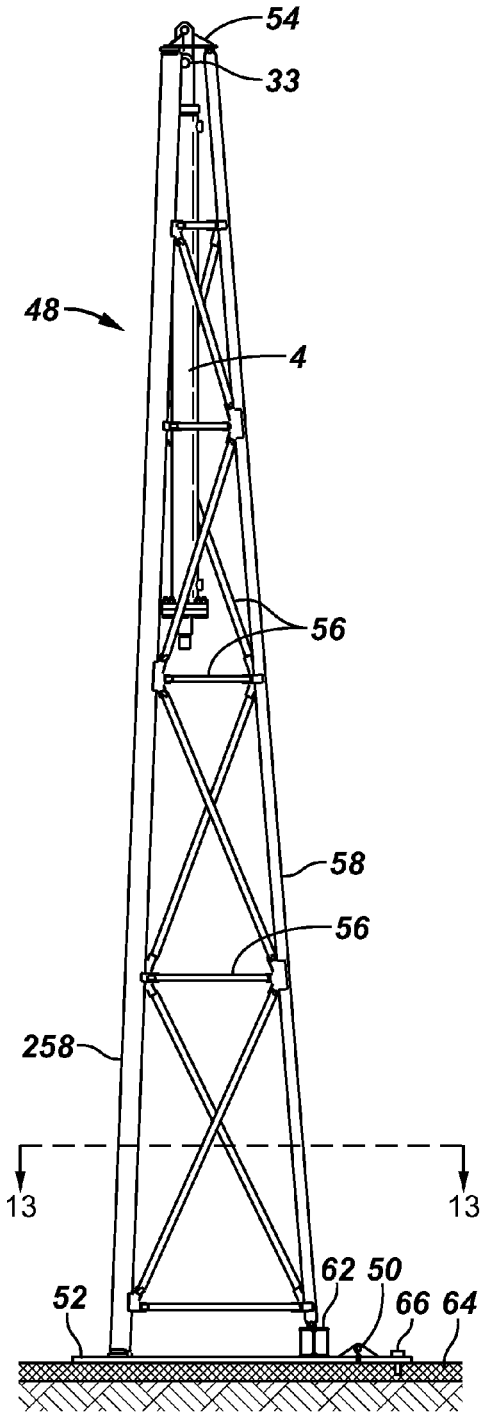
FIG. 10 is a side pictorial view of a derrick carrying a cylinder according to one embodiment of the invention.
Figure 11:
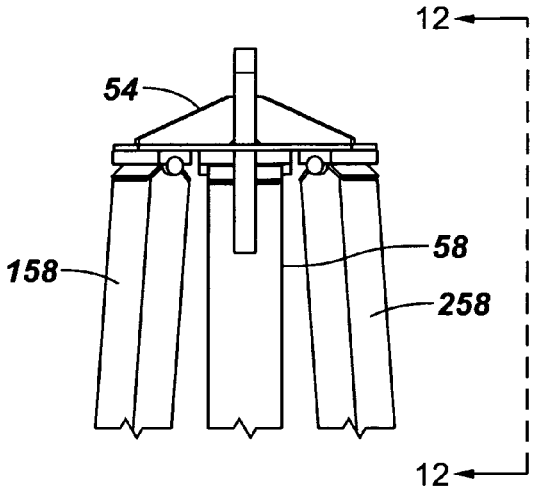
FIG. 11 is a pictorial view of a portion of the derrick shown in FIG. 10.
Figure 12:
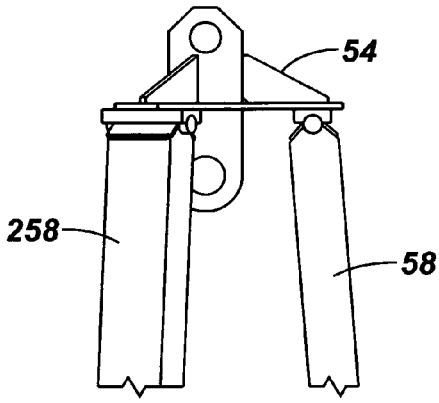
FIG. 12 is a pictorial view of the portion of the derrick shown in FIG. 11 viewed along lines 12-12.
Figure 13:
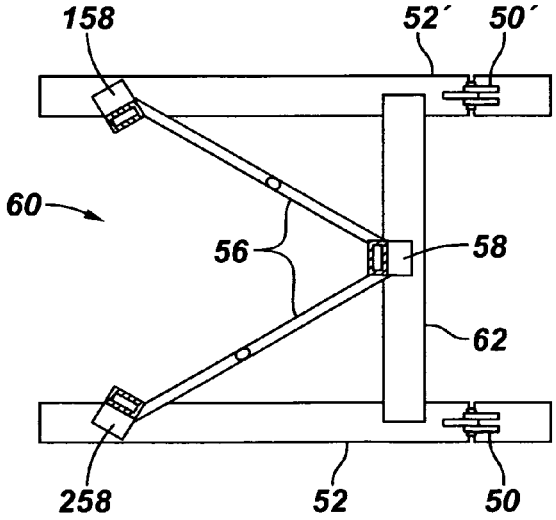
FIG. 13 is a cross-sectional view of a portion of the derrick shown in FIG. 10 taken along lines 13-13.

The position sensor can include a probe which is inserted into the cylinder through port 21 shown in FIG. 9. The probe can contain a magnetostrictive wire which senses the position of a magnet 23 carried alongside the piston and produces a signal which is received by the position transducer mounted on the cylinder head. The probe is positioned in a central borehole 27 of the cylinder shaft 29 which extends through the bottom head 22 and is connected to the sucker rod. A yoke 31 at the upper end of the cylinder provides for attachment of the cylinder to a tip top assembly 54 as shown in FIG. 10 via a cross pin 33.

The control system preferably includes a computer 44 (FIGS. 7 and 8) which receives signals from the at least one position sensor and computer instructions operably associated with the computer for processing said signals and producing an output signal for actuating the pump unit, such as by actuating the at least one actuator for the plate.

The control system preferably includes a user interface operably associated with the computer for inputting at least one command signal 274 indicative of at least one desired velocity parameter for the piston, and computer instructions for receiving said at least one command signal and producing an output signal 272 for actuating the pump unit to produce the at least one velocity parameter for piston. In FIG. 7, user interfaces are provided in the form of a keypad 266 and display 268.

The control system preferably includes at least one pressure sensor B (FIGS. 7 and 8) positioned to measure pressure in the first conduit for hydraulic fluid and to produce an electrical signal representative of the pressure. The signal is received by the computer. The computer is provided with computer instructions operably associated with the computer for producing a pump cycle dynamometer card associating the pressure with a calculated piston position over the course of a pump cycle. The pump cycle dynamometer data card is stored in an electronic memory operably associated with the computer. The electronic memory contains a plurality of cards. Preferably, at least one pressure sensor A is positioned to measure pressure in the second conduit for hydraulic fluid and to produce an electrical signal representative of the pressure therein which is received and processed by the computer is also provided.

The control system preferably includes computer instructions for comparing different pump cycle dynamometer data cards and generating an alert signal in the event that the compared dynamometer data cards differ by more than a predetermined amount.

The apparatus preferably further includes a transmitter system 45 (FIG. 7) for transmitting the alert signal to a remote location. The apparatus preferably further includes a receiver system 46 for receiving data signals from a remote location and more preferably further includes means for relaying the received data signals to remote location, and/or using the data signals as command signals for controlling the actuator for the pump unit.

Figure 14:
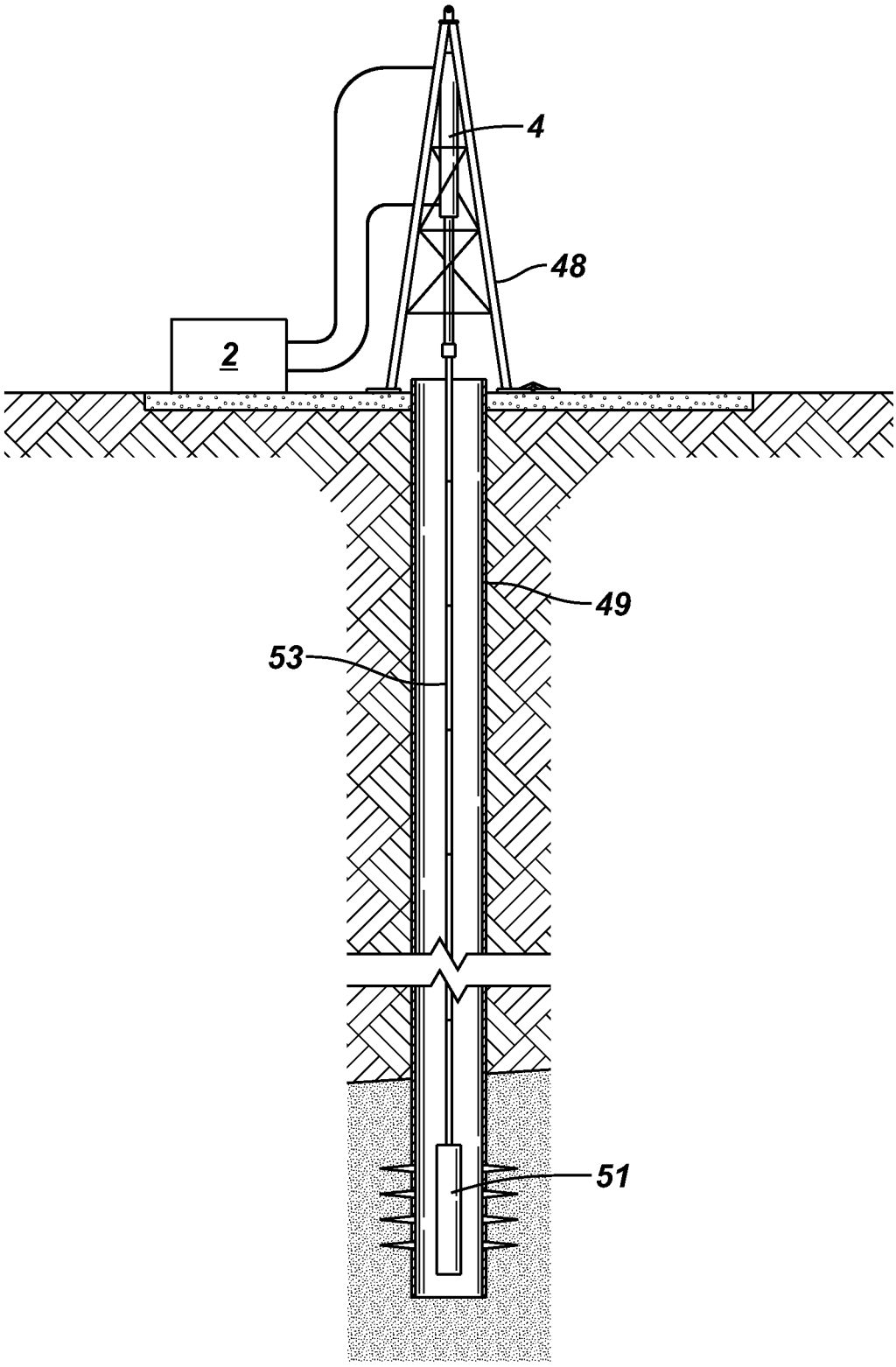
FIG. 14 is a schematic illustration, not to scale, showing use of an embodiment of the invention to pump a well.

The apparatus preferably further includes a derrick 48, a well 49 containing a downhole pump 51, and a sucker rod string 53 connecting the piston and the downhole pump. See FIG. 14. The derrick has an upper end and a lower end. The hydraulic cylinder 4 is suspended from the upper end of the derrick. The sucker rod string connects the piston and the downhole pump. The sucker rod string constitutes a part of the load urging the piston toward the lower head.

The derrick is preferably of modular construction, is engineered to support at least a 30,000 pound load, and is at least 25 feet tall. See FIGS. 10 through 13. It preferably has a total weight of less than a ton, with the individual parts weighing no more than 100 pounds, so that it can be transported to the well site in a light truck and assembled on site.

In a preferred embodiment the derrick 48 comprises a tripod derrick. The derrick comprises a first leg 58, a second leg 158, and a third leg 258, each leg having an upper end and a lower end.

The derrick further comprises a first runner strip 52 and a second runner strip 52' each having a first portion and a second portion and a hinge 50, 50' connecting the first portion and the second portion. The derrick further comprises a tip-top assembly 54 and a cross-brace beam 62. The tip-top assembly is connected to the upper end of each of the first leg, the second leg, and the third leg. The first runner strip and the second runner strip are positioned side by side and parallel to each other and the cross brace beam connects the first portion of the first runner strip and the first portion of the second runner strip at a position near the hinge. The lower end of the first leg is mounted to the cross brace beam near a location midway between the first runner strip and the second runner strip. The lower end of the second leg is mounted to the first portion of the first runner strip, the cross brace being connected between the second leg and the hinge, and the lower end of the third leg is mounted to the first portion of the second runner strip, the cross-brace being connected between the third leg and the hinge. The legs are laid out in a triangular pitch and are inclined inwardly and upwardly toward the tip-top assembly.

Preferably, diagonal and horizontal bracing 56 is positioned between the first leg and the second leg and between the first leg and the third leg. However, no bracing is positioned in a space 60 between the second leg and the third leg, so that the interior of the tripod structure is readily accessible. The derrick can be secured to a foundation 64 by at least one fastener 66 securing the second portion of each of the runner strips to the foundation. It can be assembled at ground level, attached to the foundation, and tipped into position with a truck. It can also be tipped off of the well, to provide generous well-head access for workers without first requiring disassembly. Currently, removing a pump jack from the wellhead requires a man to climb on top, loosen the horse head, and remove it with a crane. The remainder of the unit, being unmoved, still restricts access to the wellhead.

FIGS. 2-6 demonstrate preferred control schemes for the unit. The unit can be controlled according to velocity, and it can be controlled according to load, by way of velocity. The ability to control for both velocity and load give the unit inherent flexibility of utility, as is demonstrated in the example of combining both to keep the downstroke load above a user-defined threshold. The unit can also be automatically shut down if it is determined that mechanical damage or a pump-off condition has occurred downhole.

Figure 2:
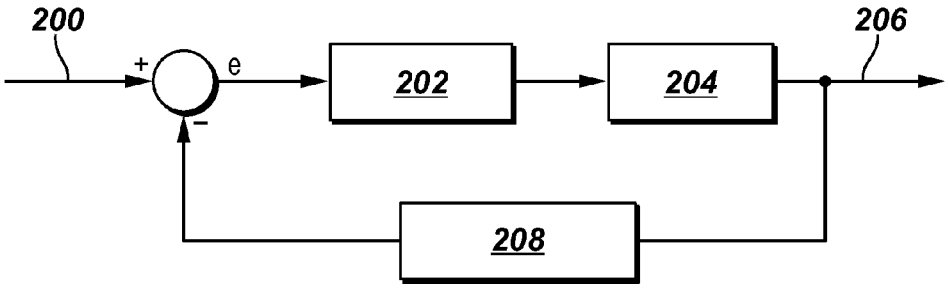
FIG. 2 is a block diagram of a rod velocity feedback control system that can be employed in the invention.

In FIG. 2, the diagram represents the preferred feedback control loop used to stroke the cylinder in accordance with the velocity profile. The computer calculates a signal "+" that is a "best guess" of the signal required by the pump to effect the desired velocity in the cylinder. The actual cylinder velocity is compared to the desired velocity "−", and an error signal "e"

is generated to correct it. This loop is continuous, and describes the process and elements needed to control the cylinder velocity. In FIG. 2, signal 200 represents "r=pump displacement signal", box 202 represents "pump displacement control", box 204 represents "cylinder rod", item 206 represents "cylinder rod velocity", and box 208 represents "time, cylinder rod position sensor".

Figure 3:
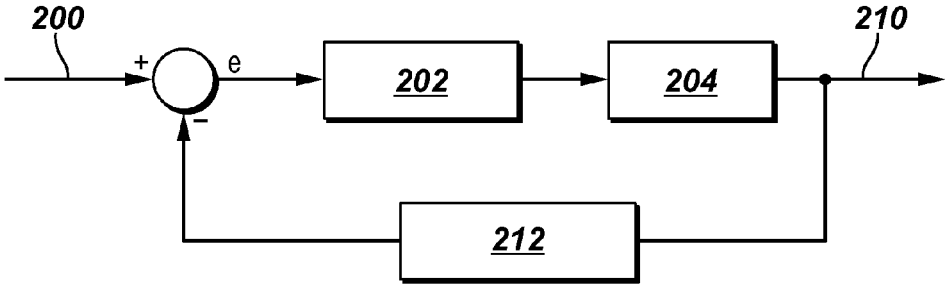
FIG. 3 is a block diagram of a rod load feedback control system that can be employed in the invention.

In FIG. 3, the diagram represents the preferred feedback control loop used to stroke the cylinder in such a way to effect a desired rod load. The computer calculates a signal "+" that is a "best guess" of the signal required by the pump to effect a velocity in the cylinder that results in a desired rod load. The actual rod load "−" is compared to the desired rod load, and an error signal "e" is generated to adjust the velocity. This loop is continuous, and describes the process and elements needed to achieve a desired rod load by changing the cylinder velocity. In FIG. 3, signal 200 represents "r=pump displacement signal", box 202 represents "pump displacement control", box 204 represents "cylinder rod", item 210 represents "developed well load", and box 212 represents "pressure transducers, cylinder rod position sensor".

Figure 4:
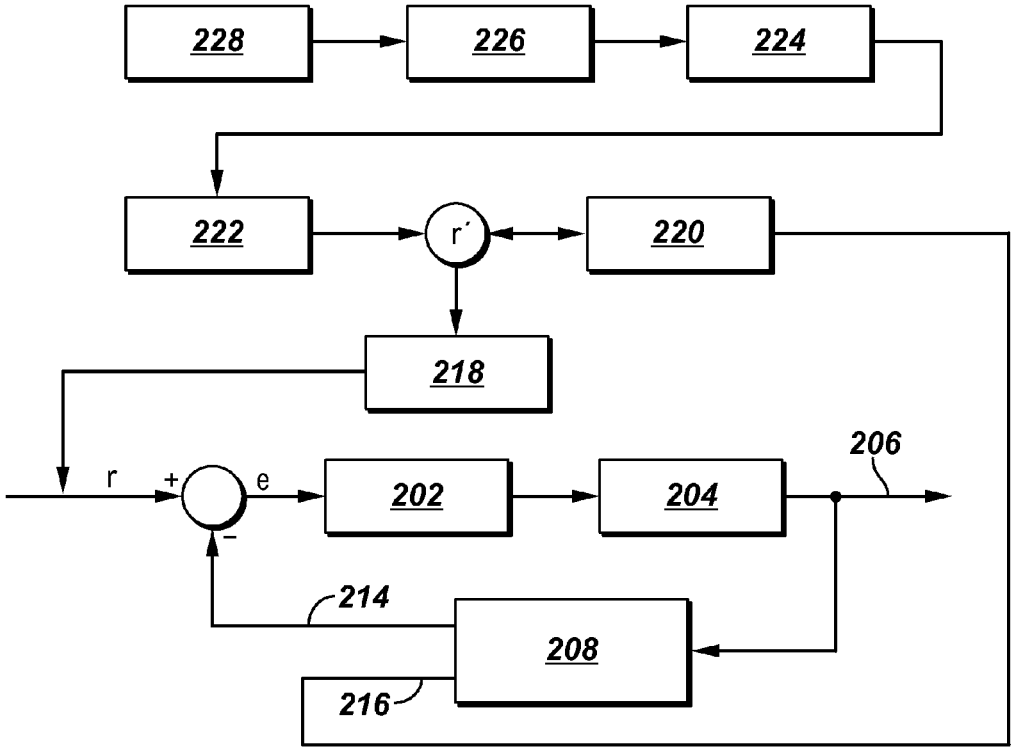
FIG. 4 is a block diagram of a stoke rate feedback control system that can be employed in the invention.

In FIG. 4, the diagram details the preferred process of creating a velocity profile that will dictate how the unit is reciprocated, and the well pumped. In this case, the user describes a predetermined stroke profile by inputting data in the following way: (a) stroke rate (strokes per minute) (b) ratio of peak upstroke velocity to peak downstroke velocity (c) percentage of each stroke spent accelerating or decelerating. The stroke profile is stored as a table of position and velocity. Then, as the cylinder moves, the position is fed back into the table, and a desired velocity is sent to the velocity controller, which works to achieve this velocity. In FIG. 4, box 202 represents "pump displacement control", box 204 represents "cylinder rod", box 206 represents "cylinder rod velocity", box 208 represents "time, cylinder rod position sensor", item 214 represents "velocity", item 216 represents "position", item 218 represents "r (pump displacement)=r' X pump displacement coefficient", item 220 represents the step of "store velocity profile as table: position vs. velocity", item 222 represents the step of "compute stroke velocity profile, r'=cylinder velocity", item 224 represents the step of "input acceleration and deceleration time (%)", item 226 represents the step of "input ratio of upstroke and downstroke velocity", and item 228 represents the step of "input desired stroke rate".

Figure 5:
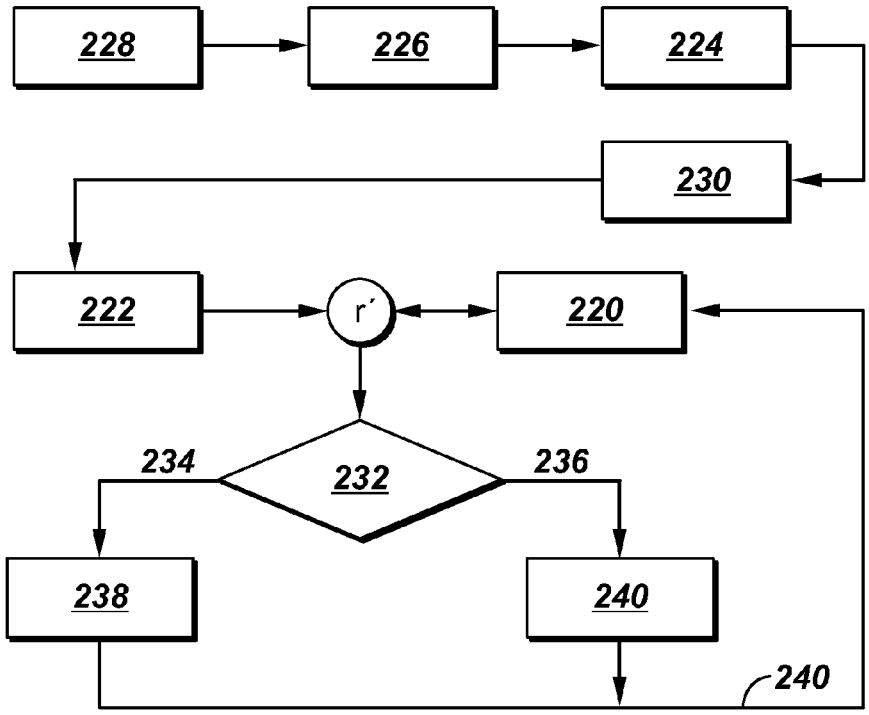
FIG. 5 is a block diagram of a stroke rate and load feedback and control system that can be employed in the invention.

In FIG. 5, the diagram describes how the velocity and load feedback can be used in conjunction with one another. Here, the user creates a predetermined velocity profile for the stroke, and also enters a minimum downstroke load. The unit will work to achieve the desired velocity profile, but will constrain the downstroke motion to prevent the load from falling below the user defined threshold. In FIG. 5, item 220 represents the step of "store velocity profile as table: position vs. velocity", item 222 represents the step of "compute stroke velocity profile, r'=cylinder velocity", item 224 represents the step of "input acceleration and deceleration time (%)", item 226 represents the step of "input ratio of upstroke and downstroke velocity", item 228 represents the step of "input desired stroke rate", item 230 represents the step of "input minimum downstroke load", item 232 represents the determination step of "upstroke?", item 234 represents the decision step of "yes", item 236 represents the decision step of "no", item 238 represents "rod velocity feedback control", item 240 represents "rod load feedback control", and item 242 represents "position".

Figure 6:
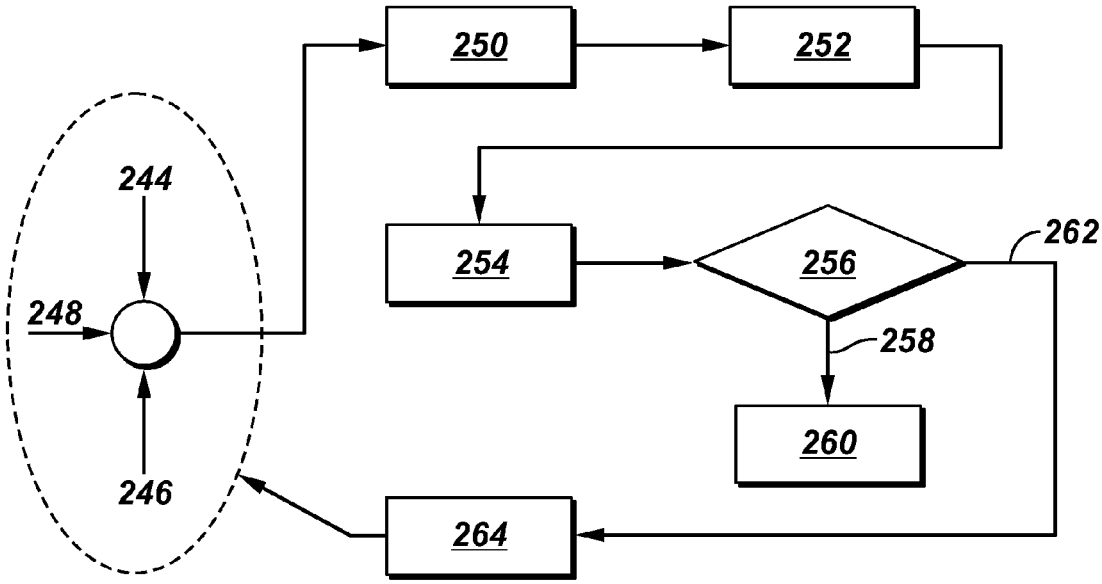
FIG. 6 is a block diagram of a pump off alert control system that can be employed in the invention.

FIG. 6 shows the logic for calculating a pump dynamometer card for each stroke and comparing the cards to determine if the work being performed by the unit is changing. In the event that work decreases over time, an alert signal can be radio transmitted to a remote location, and/or the unit shut down. The computer can also be provided with instructions for comparing different pump cycle dynamometer data cards and producing an output signal for actuating the pump unit to reduce at least one velocity parameter for the piston in the event that work per pump cycle decreases more than a predetermined amount, or to increase at least one velocity parameter for the piston in the event that work per pump cycle increases more than a predetermined amount. In FIG. 6, item 244 represents "$P_A$=pressure at 'A'", item 246 represents "$P_B$=pressure at 'B'", item 248 represents "X=position", item 250 represents "well load (lbs)=$P_B$ X cylinder area", item 252 represents the step of "plot well load vs. position to create dynamometer card, WELL_LOAD=f(X)", item 254 represents the step of "calculate work performed per stroke, work=WELL_LOAD", item 256 represents the determination step of "is work decreasing?", item 258 represents the decision step of "yes", item 260 represents "pump-off alert signal", item 262 represents the decision step of "no", and item 264 represents the step of "continue pumping and calculate next dynamometer card".

Another aspect of the invention provides a method for pumping a well. In the method, a sucker rod actuated pump is provided in the well. The pump is connected via a sucker rod string and piston shaft to a piston in a hydraulic cylinder positioned at the wellhead. The piston divides the hydraulic cylinder into an upper chamber and a lower chamber. Hydraulic fluid is supplied to the lower chamber to move the piston to an upper limit of travel near the upper end of the hydraulic cylinder. The piston reaching its upper limit of travel is sensed. Then hydraulic fluid is removed from the lower chamber to permit the piston move to a lower limit of travel near the lower end of the hydraulic cylinder. The piston reaching its lower limit of travel is sensed. Then these last four steps are repeated to pump fluids from the well.

The last four steps constitute a pump cycle. Preferably, the position of the piston is sensed over time for each pump cycle, and the sensed position of the piston in the hydraulic cylinder is recorded against time for each pump cycle. The supply rate of hydraulic fluid to the lower chamber as well as the removal rate of hydraulic fluid from the lower chamber is controlled to cause the piston to move to predetermined positions against time.

More preferably, the pressure at which hydraulic fluid is supplied to the lower chamber is sensed over time and recorded against time for each pump cycle, and the pressure at which hydraulic fluid is removed from the lower chamber is sensed over time and recorded against time for each pump cycle. The recorded pressure information is then compared against previously recorded pressure information to determine if a pressure change at some point in the cycle has occurred.

In the event that a pressure change has occurred, new predetermined positions to move the piston to against time are established, and the supply rate and removal rates of hydraulic fluid to the lower chamber are controlled to cause the piston to move to the new predetermined positions against time.

Preferably, the method is carried out employing back-pressure to counterbalance the well load. The hydraulic fluid to be supplied to the lower chamber is taken from a gas pressurized vessel, and the hydraulic fluid removed from the lower chamber is supplied to the gas pressurized vessel.

Figure 15:
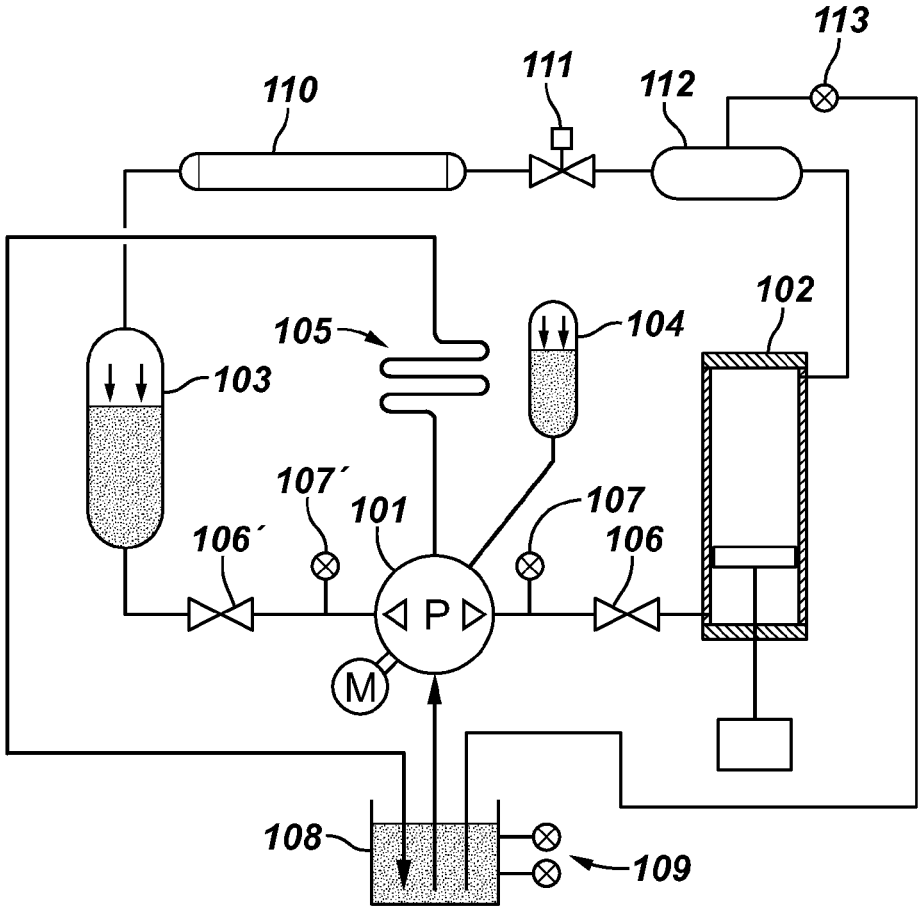
FIG. 15 is a process schematic of another embodiment of the invention.

FIG. 15 describes a machine that is used to raise and lower a load. The machine corresponds to apparatus 2 in FIG. 1. The load, corresponding to load 6 in FIG. 1, is attached to the cylinder 102 (corresponding to hydraulic cylinder assembly 4 in FIG. 8). The load always acts downward, but can vary in magnitude. The machine is powered by an electric motor (corresponding to motor 42 in FIG. 8) which is correctly sized to each individual application. The site is outdoors and remote. The machine is installed permanently on site and operated continuously for minutes to weeks at a time, reciprocating the cylinder under load. When the machine stops and starts, it does so based on a signal from a computer (corresponding to computer 44 in FIG. 8) to the electric motor.

Figure 16:
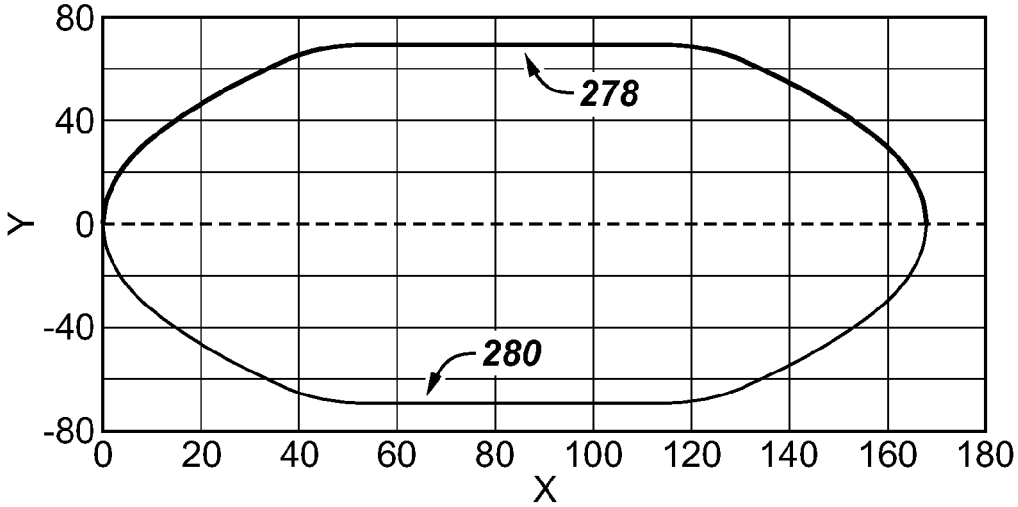
FIG. 16 is a representative graph of a pump rod velocity profile that can be provided according to an embodiment of the invention.

The pump also receives a control signal from the computer. The computer directs the pump to induce the cylinder to reciprocate. The position of the cylinder is read, and the computer strives to make the cylinder follow a predefined velocity profile, like the one shown in FIG. 16. In FIG. 16, item 278 represents upstroke profile, and item 280 represents the downstroke profile. X represents stroke position (inches) and Y represents velocity (in/sec). The pump and cylinder are part of a feedback control loop.

Theory of Operation

When driving the cylinder up, the pump 101 (corresponding to motor 42 and pump unit 43 in FIG. 8) takes pressurized fluid from the piston accumulator 103 (corresponding to 10 in FIG. 8), and pumps it into the cylinder 102. When allowing the cylinder to fall, the pump takes fluid from the cylinder 102 and pumps it into the piston accumulator.

The pressure required to lift the cylinder rod ($P_{CYL\text{-}UP}$) is greater than the pressure required to lower the cylinder rod ($P_{CYL\text{-}DOWN}$) such that:

$$P_{CYL\text{-}UP}>P_{CYL\text{-}DOWN}$$

The nitrogen tank with regulator 111 (40 in FIG. 8) is pressurized ($P_{CBAL}$) to a level halfway between the upward ($P_{CYL\text{-}UP}$) and downward ($P_{CYL\text{-}DOWN}$) pressures such that:

$$P_{CBAL}=(P_{CYL\text{-}UP}+P_{CYL\text{-}DOWN})/2$$

In this manner, the pump will always drive fluid from a higher pressure vessel to a lower pressure vessel because:

$$P_{CYL\text{-}UP}>P_{CBAL}>P_{CYL\text{-}DOWN}$$

Due to inherent internal pump leakage, the piston accumulator will always tend to "run out" of fluid to supply the pump 101 near the top of the cylinder stroke. This tendency can induce cavitation in the pump. The bladder accumulator 104 (corresponding to 80 in FIG. 8) is included in the system to provide a readily available boost of fluid internally to the pump so that the pump displacement has time to adjust to the loss of pressure at a main port, thereby avoiding the cavitation.

Also, the pump strives to not allow the pressure at the main ports to go below the pump's charge pressure. The cylinder will not fall if $P_{CYL\text{-}DOWN}$ is less than the pump's charge pressure. The cylinder ballast reservoir 112 (placed in flow communication with line 32 in FIG. 8 and the nitrogen tank 40 via the regulator) is provided to ensure that under zero rod load, the rod will still fall. Any oil that is forced into the cylinder ballast reservoir could cause the pressure in the reservoir to rise undesirably. The relief valve 113 (also placed in flow communication with line 32 in FIG. 8, in a line connecting the cylinder ballast reservoir to the tank 108) is provided so that oil accumulating in the cylinder ballast reservoir will be forced into the tank 108 (corresponding to 30 in FIG. 8) at the desired pressure.

Make-Up Hydraulic Fluid Supply

Due to the inherent leakage in the pump 8 (true for all pumps of this type), the main accumulator will sometimes run out of oil before the piston 24 is fully urged to the top of the stroke.

To overcome this, with reference to FIGS. 1 and 7, an auxiliary pump 301 pumps a small rate of hydraulic oil to a "pilot-to-shift" 3-way valve 302. The valve senses the pressure in the main counter-balance accumulator 10 and a smaller auxiliary counter-balance accumulator 104. As long as the pressure in the auxiliary counter-balance accumulator 104 is below the main counter-balance accumulator 10, the valve allows the auxiliary pump 301 to charge the auxiliary accumulator. When the pressure in the auxiliary accumulator reaches that in the main accumulator, the valve "shifts" and sends oil back to the tank. This function of the "pilot-to-shift" valve is similar to that of an unloading valve, but not identical. As the main accumulator runs out of oil, the pressure in the main accumulator will drop, which would normally cause a loss in counter-balance pressure or possibly pump cavitation. In the system illustrated, the auxiliary accumulator will discharge through the check valve 305 into the main counter-balance line, thus eliminating the loss of counter-balance pressure and pump cavitation. When the pressure of the gas pressurized vessel drops below a predetermined pressure, hydraulic fluid is automatically added to prevent further pressure loss.

In one embodiment, an auxiliary pressure vessel 104 contains a pressurized supply of hydraulic fluid compatible with the hydraulic pump assembly. The auxiliary pressure vessel contains hydraulic fluid in a lower portion thereof and a head of pressurized gas in an upper portion thereof. A third conduit 310 including an auxiliary pump 301 connects the auxiliary pressure vessel with the hydraulic fluid reservoir 30. The auxiliary pump pumps fluid into the pressure vessel to pressurize the gas in the upper portion thereof. A fourth conduit 312 connects a lower portion of the auxiliary pressure vessel into flow communication with the second conduit 14. The fourth conduit includes the valve 305 which opens in response to a predetermined pressure difference between the reservoir of hydraulic fluid and the second conduit to provide hydraulic fluid flow from the auxiliary pressure vessel to the pump assembly in response to need. The apparatus preferably includes a shift valve 302 operatively associated with the third conduit means between the auxiliary pump and the auxiliary pressure vessel for conveying hydraulic fluid to the pressure vessel when shifted to a first position or, alternatively, for return to the auxiliary pump when shifted to a second position. The shift valve is actuated in response to the balance of pressures at points 314 and 316. The shift valve remains in the first position until the pressure signals are equal then shifts to the second position.

Specific Hardware Relating to an Exemplary Embodiment

Item 101 Variable Displacement Axial Piston Pump
Bidirectional Flow, 0-94.1 gpm
0-5000 psi continuous operation pressure
Responds to voltage or current input control signal
Response time, zero to full, 0.75 sec or less
Item 102 Hydraulic Cylinder, 5K psi, 173"
5000 psi working pressure
173 inch usable stroke length
Vertical orientation, rod side down
Rod in tension only, 0-24000 lbs
Rod designed for infinite fatigue life
Embedded PWM position sensor 2" Pin Connection
Double Acting
Operates with lubrication on only one side of the piston
Requires less than 250 lbs, in addition to rod weight, to raise or lower the rod
70 in/sec peak rod velocity
Item 103 Piston Accumulator, 5K psi
5000 psi working pressure
4.25 Gallon oil volume minimum
Must withstand cycling under pressure to lower limit (bottoming out)
Item 104 Bladder Accumulator
1.5 Gallon oil volume minimum
1000 psi working pressure
Item 105 Air/Oil Cooler (corresponds to cooler 16 in FIG. 8)
120V AC electric fan
Dissipate 23 HP (min) @20 GPM
Items 106, 106' Ball Valves, 5 K psi (correspond to valves 34 and 36 in FIG. 8)
5000 psi working pressure
Items 107, 107' Pressure Transducer (positioned at ports A and B in FIG. 8)
0-5000 psi operating range
1-5 VDC output
Accuracy, +/−0.4% BFSL
Hysteresis, +/0 0.2% BFSL
Repeatability +/−0.05% FS
Stability, +/−1.0%/year
Item 108 Reservoir, 40 Gal
40 Gal capacity
Standard Thermometer and sight gauge
Sealed Cap with water excluding breather or excluding breather cap
Item 109 Temp/Level indicator and switch
Measurement of Reservoir temperature and level
2 switching outputs (level or temp).
1 analog output (temp or level).
Item 110 Nitrogen Reservoir
14 Gal volume minimum
5000 psi working pressure
Item 111 Nitrogen Pressure Regulator
5000 psi supply pressure
0-500 psi output pressure
Item 112 Cylinder Ballast Reservoir
250 psi working pressure
11 gal volume minimum
Item 113 Relief Valve
Air or Oil
250 psi While certain preferred embodiments of the invention have been described herein, the invention is not to be construed as being so limited, except to the extent that such limitations are found in the claims.

The invention claimed is:

1. A tripod derrick, said derrick comprising
a first leg having an upper end and a lower end,
a second leg having an upper end and a lower end,
a third leg having an upper end and a lower end,
a first runner strip having a first portion and a second portion and a hinge connecting the first portion and the second portion,
a second runner strip having a first portion and a second portion and a hinge connecting the first portion and the second portion,
a tip-top assembly, and
a cross-brace beam,
wherein
the tip-top assembly is connected to the upper end of each of the first leg, the second leg, and the third leg,
the first runner strip and the second runner strip are positioned side by side and parallel to each other;
the cross brace beam connects the first portion of the first runner strip and the first portion of the second runner strip at a position adjacent the hinge;
the lower end of the first leg is mounted to the cross brace beam substantially at a location midway between the first runner strip and the second runner strip,
the lower end of the second leg is mounted to the first portion of the first runner strip,
the cross brace being connected between the second leg and the hinge,
the lower end of the third leg is mounted to the first portion of the second runner strip,
the cross-brace being connected between the third leg and the hinge,
said legs being laid out in a triangular pitch inclining inwardly and upwardly toward the tip-top assembly;
in combination with a foundation and at least one fastener securing the second portion of each of the runner strips to the foundation, so that the derrick can be tipped into position on a well.

2. A tripod derrick as in claim 1 further comprising bracing between the first leg and the second leg, and between the first leg and the third leg, and the absence of bracing between the second leg and the third leg, so that the interior of the tripod structure is readily accessible.

* * * * *